US005330865A

United States Patent [19]

Leus et al.

[11] Patent Number: 5,330,865

[45] Date of Patent: Jul. 19, 1994

[54] MULTI-LAYERED ELECTROPHOTOGRAPHIC ELEMENT HAVING A MIXTURE OF PERYLENE PIGMENTS

[75] Inventors: Gerardus R. B. Leus, CV Venlo; Achilles W. M. Persoon, CR Maasbree; Clemens T. Weijkamp, RR Zijtaart, all of Netherlands

[73] Assignee: Oce-Nederland, B.V., MA Venlo, Netherlands

[21] Appl. No.: 959,092

[22] Filed: Oct. 9, 1992

[51] Int. Cl.[5] ..... G03G 5/06

[52] U.S. Cl. ..... 430/59; 430/78

[58] Field of Search ..... 430/58, 59, 78

[56] References Cited

U.S. PATENT DOCUMENTS

| | | | |
|---|---|---|---|
| 4,937,164 | 6/1990 | Dutt et al. | 430/58 |
| 5,077,161 | 12/1991 | Law | 430/58 |
| 5,192,634 | 3/1993 | Ichimura et al. | 430/85 |

OTHER PUBLICATIONS

Research Disclosure Oct. 1991, Mixtures of Perylene--Pigments for Use in a Photoconductive Element, pp. 818-819.

*Primary Examiner*—John Goodrow

*Attorney, Agent, or Firm*—Birch, Stewart, Kolasch & Birch

[57] ABSTRACT

A multi-layered electrophotographic element providing significantly improved properties, especially for use in photocopying and printing, which comprises a conductive support carrying a photoconductive layer comprising a photoconductive charge generating layer and a charge transporting layer on the charge generating layer. The charge generating photoconductive layer comprises a mixture of charge generating perylene pigments of the following structures

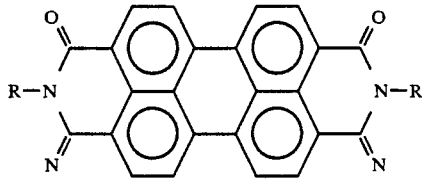

structure 1 and

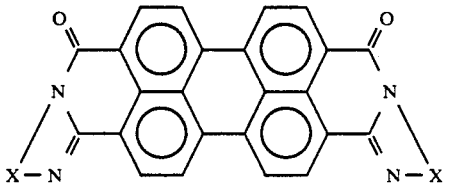

CIS

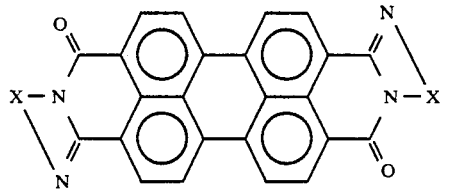

TRANS structure 2 wherein the mixture of perylene pigments is selected from pigment mixtures of a perylene of structure 1 with a perylene of structure 2, pigment mixtures of perylenes of structure 1 and pigment mixtures of perylenes of structure 2.

18 Claims, No Drawings

MULTI-LAYERED ELECTROPHOTOGRAPHIC ELEMENT HAVING A MIXTURE OF PERYLENE PIGMENTS

BACKGROUND OF THE INVENTION

1. Field of the Invention

The present invention relates to electrophotography and, more specifically, to a multi-layered electrophotographic element.

2. Description of Related Art

In electrophotography, an image is formed on an electrophotographic element generally comprising a photoconductive layer on a substrate by first providing the surface of that layer with a uniform electrostatic charge and then exposing it imagewise to light. The imagewise exposure causes the areas struck by light to become conductive and the charge in this area is discharged, while the charge in the non-exposed areas remains, forming an electrostatic latent image. This latent image is rendered visible, for example, by depositing finely divided electroscopic toner particles onto the imaged layer surface, the toner particles being attracted by the remaining charge. In direct electrophotography, the image thus rendered visible is fixed locally onto the electrophotographic element, e.g. by heat and/or pressure. In indirect electrophotography, the image formed on the photoconductive element is first transferred to and then fixed onto a support, usually of plain paper. Thereafter, any toner particles remaining on the photoconductive layer surface are cleaned therefrom to make the element suitable for a subsequent copying cycle.

The electrophotographic element in practice may comprise a radiation-sensitive charge generating layer applied to a conductive support. Alternatively, it may comprise a plurality of layers including a radiation-sensitive charge generating layer and a charge transporting layer applied thereto. Such multi-layered electrophotographic elements are described, for example, in U.S. Pat. Nos. 3 713 820, 3 725 058, 3 824 099, 3 837 851, 3 839 034 and 3 898 084.The radiation-sensitive compound or compounds in such a charge generating layer may be of an inorganic or organic nature. When inorganic material is used, it generally is present either in the form of particles dispersed in a binder or in the form of a homogeneous film obtained, for example, by vapor deposition. Selenium is the inorganic material most commonly used. When organic material is used, it may, for example, be present in the form of a film-forming organic polymer, such as, for example, a polyvinyl carbazole or polyvinyl pyrene, or in the form of finely divided pigment particles, such as, for example, bisazo pigments, of which Phenelac Blue and its derivatives are among the best known, which are dispersed in an organic binder.

Such pigment-binder layers, however, have exhibited a number of disadvantages. Hence, processes have been proposed for preparing charge generating layers in which the radiation-sensitive compound is present in a molecularly divided form instead of in the form of pigment particles. The advantage of the former is that the layers can be made much thinner and smoother than pigment-binder layers and are also better in respect of their charge transport and resolving powers. Furthermore, the grinding operations required for the preparation of pigment-binder layer compositions can be dispensed with.

Charge generating layers containing radiation-sensitive compounds in molecularly divided form are described, for example, in U.S. Pat. Nos. 4 123 270 and 4 286 040 and in U.K. patent No. 1 172 355. Recently organic photo generating pigments such as perylene pigments, bisazo pigments, quinone pigments, and phtalocyanine pigments have been used. Such pigments can be evaporated fairly easily in a vacuum and subsequently can be deposited on a suitable substrate to obtain thin extremely homogeneous layers.

When, because of their associated advantages, it is desired to use such layers in the thinnest possible form, e.g. at a thickness of not more than 1 to 2 μm, they must be provided with a top layer because of the vulnerability of the extremely thin layers to abrasion, and in order to be able to bring them to the required charge level during uniform charging. The top layer to be used must also permit the transport of charge carriers, usually holes, which are formed in the charge generating layer during the imagewise exposure.

Perylene pigments are widely used in charge generating layers in photoconductive elements for electrophotography. The currently used perylenes have properties which make them suitable for a wide variety of photoconductors. However, there remains a need for improved photoconductive elements in, for example, electronic printers, such as laser printers, where sensitivity in the near infrared is often required. Also, there remains a need for photoconductors with an improved photosensitivity, low residual charge after illumination, a rapid discharge rate and low dark decay.

SUMMARY OF THE INVENTION

Therefore, it is an object of the present invention to provide an electrophotographic element which will overcome the above noted disadvantages.

It is a further object of the present invention to provide an improved multi-layered electrophotographic element with a high photosensitivity, low residual charge after illumination, a rapid discharge rate and low dark decay.

It is another object of the present invention to provide electrophotographic elements with improved sensitivity in the near infrared portion of the electromagnetic radiation spectrum.

It is still a further object of the present invention to provide an improved electrophotographic element with an azine containing charge transporting layer and a charge generating layer comprising a mixture of perylene pigments.

Yet, still a further object of the present invention is to provide an electrophotographic imaging process utilizing a novel electrophotographic element.

The foregoing objects and other are accomplished in accordance with the present invention, generally speaking, by providing an electrophotographic element comprising a photoconductive layer on a substrate. The photoconductive layer of the present invention comprises an azine containing charge transport layer and a charge generating layer comprising a mixture of perylene pigments. Examples of perylene pigments which can be used advantageously in the multi-layered electrophotographic elements of the invention are perylenes of the structures

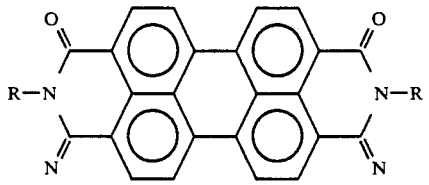

structure 1 and

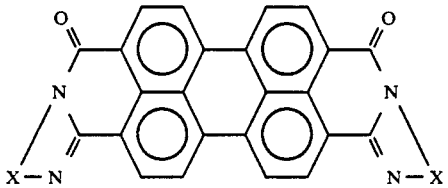

CIS

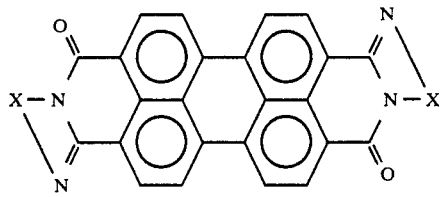

TRANS structure 2 wherein R can be e.g. an aryl, alkyl, aralkyl, alkaryl, naphtyl, alkoxyaryl or a heterocyclic group and their substituted derivatives; and X can be e.g. a phenylene, naphtylene, pyridylene or phenanthrene group and the corresponding alkyl, aryl, aralkyl, nitro, chloro, bromo and methoxy substituted derivatives of these groups. These compounds (structure 2) are usually present in cis-trans mixtures.

The perylene compounds illustrated herein are prepared by reacting 3, 4, 9, 10 perylenetetracarboxylic acid with e.g. an amine, a diamine, an amide. Details about the preparation methods are described in GB 1 337 225, GB 1 416 603, GB 1 469 169 and DE 30 19 326; the disclosure of each of the aforementioned patents are herein incorporated by reference.

DETAILED DESCRIPTION OF THE INVENTION

In accordance with the present invention an electrophotographic element is prepared by coating a photoconductive layer on a substrate. The photoconductive layer comprises a charge generating layer comprising a mixture of perylene pigments. A charge transport layer is generally provided over the charge generating layer.

Any suitable perylene pigment may be utilized in accordance with the present invention. Examples of mixtures of perylene pigments which have proved to be suitable are mixtures of the perylenes of structure 1, mixtures of the perylene pigments of structure 2 and mixtures of a perylene pigment of structure 1 with a perylene pigment of structure 2.

The above mixtures exhibit improved photoelectric properties, in that they have an unexpected higher photosensitivity, a better quantum yield over the entire spectral region, and a steeper discharge curve. Mixtures coated on a substrate of a perylene pigment of structure 1, wherein R is an alkaryl group such as

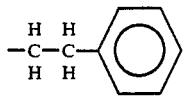

(I)

with a pigment of structure 2, exhibit not only improved photoelectric properties but also improved adhesion to the substrate in comparison with the adhesion of the individual perylenes. The aralkyl group can be substituted or unsubstituted. In particular a multi-layered electrophotographic element with a charge generating layer comprising a mixture of a first perylene pigment of structure 1, wherein

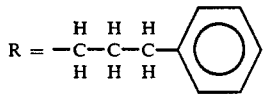

(II)

and a second perylene pigment of structure 2, wherein

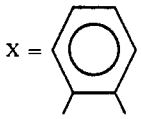

O-phenylene (III)

or

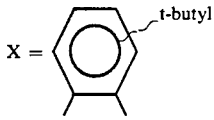

t-butyl-o-phenylene (IV)

shows good results. The latter pigment is used as a cis-trans mixture. The photosensitivity increased approximately 20–30% with respect to the photosensitivity of the perylenepigments II and III used solely in the charge generating layer, both using white light and light in the wave length of 700 μm.

Mixtures of perylene pigments in which a first perylene pigment of structure 2, and a second perylene pigment of structure 2 are used show similar results. Examples of suitable pigments for such mixtures are perylene pigments wherein X=o-phenylene (III) and X=t-butyl-o-phenylene (IV).

Mixtures of perylene pigments, comprising a first perylene pigment of structure 1 and a second perylene pigment of structure 1 can also successfully be used in a charge generating layer of the multi-layered electrophotographic element according to the invention. Examples of suitable pigments for such mixtures are amongst others perylene pigments in which

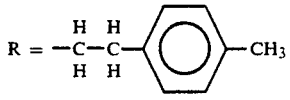

(V)

and

-continued (VI)

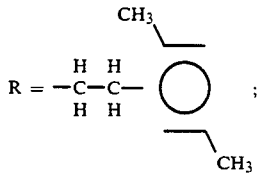

pigment VI and a perylene pigment in which (VIII)

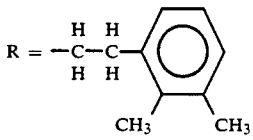

Advantageously, a mixture can be used of predominantly a first perylene pigment of structure 1, wherein R=2-methylbutyl (VIII), and a second perylene pigment of structure 1, wherein R=n-propylfenyl (II), preferably in a ratio of the first to the second pigment of from 60:40 to 10:90 by weight and more preferably from 40:60 to 10:90 by weight. Using this mixture as a generating layer the photosensitivity increased 30–50% (at 550 nm) with respect to the photosensitivity of the perylene pigments VIII and II used solely in the generating layer.

Exceptionally good results with respect to sensitivity at longer wavelengths were obtained using a multi-layered electrophotographic element wherein a conductive support is coated with a generating layer comprising a mixture of a first perylene pigment of structure 1, wherein (IX)

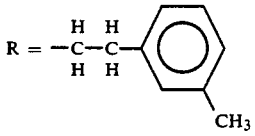

and a second perylene pigment of structure 1 (VI). Using this mixture of pigments it was found that the photosensitivity of this element increased approximately 80% at 650 nm depending on the VI/IX ratio with respect to an electrophotographic element with a generating layer of the same thickness with only pigment IX.

The substrate may comprise a layer of organic polymeric material such as conductive Mylar (duPont) and Melinex (ICI), polyester films, a semiconductive layer or a conductive layer, such as aluminum, chromium, nickel etc. As necessary, the polymeric substrate is rendered conductive for purposes of the present invention. The present invention is eminently suited for use in indirect electrophotography in the form of an endless element the support of which is, for example, a drum or a flexible web of paper or plastic having its ends joined together.

As a charge transport layer, compositions well known in the art may be used. In particular, very good results are obtained using a multi-layered electrophotographic element comprising an electrically conductive support carrying a photoconductive radiation sensitive charge generating layer comprising the mixture of perylene pigments according to the present invention and comprising applied to this layer, a charge transport layer, containing as a charge transporting agent homogeneously distributed in an insulating binder, an azine which has the general structural formula

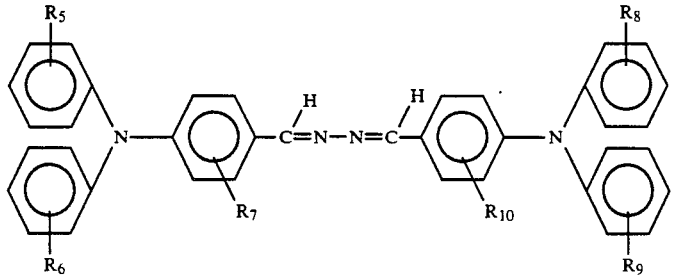

structure 3 where R5 to R10 each represents a hydrogen atom or an alkyl group having from 1 to 4 carbon atoms and can be the same or different. Such azine compounds and their use in a multi-layered electrophotographic element are described in U.S. Pat. No. 4 543 310, the disclosure of which is herein incorporated by reference.

Any suitable azine may be used to implement the present invention. Examples of azines which have proved to be suitable are for instance compounds in which R5, R6,R8 and R9 are hydrogen atoms and R7 and R10 are alkyl groups, and compounds in which R5, R6,R8 and R9 represent alkyl groups in the para or meta position and R, and $R_{10}$ are either hydrogen atoms or alkyl groups. Very good results were obtained using a charge transporting azine compound where R5, R6, R8 and R9 are para-ethyl groups and R7 and R10 are methyl groups in the meta position with respect to the tertiary amino group. Electrophotographic elements according to the invention comprising the above azine compounds as charge transporting agents show a high photosensitivity, a very low residual charge after exposure and a low dark decay even when they are charged to not more than 30–70% of their maximum apparent surface voltage (ASVmax). This aspect is of great advantage since electrophotographic elements which are charged to a level well below their ASVmax (partial charging) have a substantially greater permanence of usefulness than elements which are charged to their ASVmax. Furthermore, when using the elements according to the invention containing the azine compounds cleaning of the charge transport layer after transfer of the developed image was found to involve no problems.

The quantity of the charge transporting agent to be used in the charge transport layer of the electrophotographic elements according to the instant invention may vary within wide limits, but it generally lies between 15% and 70% by weight, based on the total quantity of solids, and preferably is between 20% and 40% by weight.

The insulating binder to be used for the charge transporting layer may be any polymeric material suitable for that purpose. Examples of suitable binder materials are polystyrenes, silicone resins, polyesters of acrylic and methacrylic acid, vinyl polymers and vinyl copolymers. Particularly good results are obtained with polycarbonate resins because of their high transparency, mechanical strength and good adhesion to a photosensitive layer.

It usually is advantageous in carrying out the invention to incorporate one ore more activators in the charge transport layer of the electrophotographic element. This particularly is the case when it is desired to charge the electrophotographic element only partially, for example, 30-70% of its ASVmax, in order to enhance permanence. An activator will improve the discharge characteristic of the element. In principle, any of the known activators can be used for this purpose.

The electrophotographic element according to the invention can be prepared by known methods. The patents referred to hereinabove describe in detail methods suitable for the preparation of both the charge generating layer and the charge transporting layer. The charge generating layers comprised of mixtures of pigments can be made using any suitable deposition technique such as evaporation in a vacuum, spray coating of solutions or dispersions, web coating or dip coating. Vacuum evaporation can be done in a vacuum coater with one or more evaporation sources. When one evaporation source is used, the pigments should be selected to have similar evaporation characteristics. If the evaporation characteristics are not similar it is necessary to use two evaporation sources, with separate temperature control.

The thickness of the charge transporting and charge generating layers can be varied over wide ranges as commonly used in the art. The thickness of the charge generating layer is preferably between about 0.1 and 2.0 μm.

Electrophotographic elements of the present invention that comprise a charge transporting layer applied to a thin charge generating layer are eminently suitable for use as a permanent master in an indirect electrophotographic copying machine. It is precisely here that their particular advantages referred to hereinabove are fully manifest, and copies of high quality can be obtained even with partial charging.

The latent image formed in the conventional manner on the charge transport layer can be rendered visible by use of either a two-component or a one-component developer. In the former case the developer consists of coarser carrier particles, usually iron particles, and very finely divided toner particles which acquire the required polarity by contact with the carrier particles. In the second case the developer consists essentially of finely divided toner particles which may be conductive (resistivity $<10^{10}$ Ohm.m) or insulating (resistivity $>10^{10}$ Ohm.m).

The electrophotographic element according to the present invention is found to be particularly well suited for development by means of a one-component developer which has advantages well known in the art, such as long term stability, insensitivity to humidity variations and making it unnecessary to monitor toner: carrier ratios (toner concentration control).

It is of course within the scope of the invention, as is well known in the art, to provide the electrophotographic element with a top layer of e.g. amorphous carbon or a diamond- like film, teflon, etc. to prevent mechanical damage to the element, to allow for easy cleaning and so forth.

Also the adhesion between the various layers can be improved by providing e.g. an adhesive layer between the various layers.

PREFERRED EMBODIMENTS OF THE INVENTION

The practice and advantages of the invention will be further understood from the following illustrative examples.

EXAMPLE 1

Preparation of a Multi-Layered Electrophotographic Element

A charge generating layer was prepared on an aluminum substrate by simultaneous evaporation in a vacuum of perylene pigment II and perylene pigment III in a 40:60 ratio by weight, and subsequent deposition. The thickness of the resulting layer on the substrate was approximately 300 nm. This layer was subsequently coated with a solution of an azine-polycarbonate mixture using a conventional dip coating technique to obtain a transport layer with a thickness of approximate 6 μm. The coating solution used, had the following composition 15g azine of structure 3, wherein R5, R6, R8 and R9 are para-ethyl groups and R7 and R10 are methyl groups, in the meta position with respect to the tertiary aminogroup, 308 g of an 8% w/w 1,2-dichloroethane solution of Lexan 141 (General Electric Co.) and 70 g tetrahydrofuran. After careful drying (24 hours at 80 C in an oven) the photoelectric properties of the resulting multi-layered electrophotographic element were determined. The results are summarized after Examples 1 to 5.

EXAMPLE 2

A multi-layered photoelectric element was prepared according to the method of example 1 using a mixture of perylene pigment II and perylene pigment III in a ratio of 20:80.

EXAMPLE 3

A multi-layered photoelectric element was prepared according to the method of example 1 using a mixture of perylene pigment II and perylene pigment III in a ratio of 50:50.

EXAMPLE 4

A multi-layered photoelectric element was prepared according to the method of example 1 using only perylene pigment III.

EXAMPLE 5

A multi-layered photoelectric element was prepared according to the method of example 1 using only perylene pigment II.

Results of the examples 1 to 5:

The photoelectric results upon partial charging to approximately −190V with an accompanying charge density of approximately 1mC/m2 are summarized in Table 1:

TABLE 1

| Example | Ratio (perylene II: perylene III) | ASV volts | DD-5 % | Rm C/J | $V_{rest}$ volts | $Rm^{700}$ C/J | $L^{700}$ (10V) ($mJ/m^2$) |
|---|---|---|---|---|---|---|---|
| 1 | 40:60 | −191 | 6.4 | 0.23 | 0 | 0.30 | 4.7 |
| 2 | 20:80 | −189 | 6.3 | 0.23 | 0 | 0.29 | 5.4 |
| 3 | 50:50 | −193 | 6.4 | 0.20 | 0 | 0.27 | 5.9 |
| 4 | 0 100 | −194 | 5.5 | 0.18 | 0 | 0.25 | 7.0 |
| 5 | 100:0 | −190 | 7 | 0.09 | 0 | n.a. | n.a. |

ASV: apparent surface voltage in volts after charging

DD-5: dark decay in the first five seconds after charging

Rm: photosensitivity, defined as the amount of positive charge (in $mC/m^2$) needed to discharge the photoconductive element completely, divided by the amount of white light ($mJ/m^2$) needed to discharge the photoconductive element completely, as derived from the slope of the initial discharge in the ASV/L discharge curve, wherein L is the amount of light in $mJ/m^2$.

Vrest: the ASV remaining after exposure with 25 $mJ/m^2$ white light.

$Rm^{700}$: photosensitivity, defined as the amount of positive charge (in $mC/m^2$) needed to discharge the photoconductive element completely, divided by the amount of light ($mJ/m^2$) with a wavelength of 700 nm, needed to discharge the photoconductive element completely, as derived from the slope of the initial discharge in the ASV/L discharge curve, wherein L is the amount of light (in $mJ/m^2$) with a wavelength of 700 nm.

$L^{700}$ (10V): the amount of light in $mJ/m^2$, with a wavelength of 700 nm, needed to discharge the photoconductive element to 10V apparent surface voltage.

n.a.: non absorbing at this wavelength.

EXAMPLE 6

A multi-layered photoelectric element was prepared according to the method of example 1, using a mixture of a perylene pigment of structure 1 with R=2-methylbutyl (VIII) and a perylene pigment of structure 1 with R=n-propylfenyl (II) with perylene VIII : perylene II ratios of 10 : 90, 20 : 80, 30 : 70 and 50 : 50 except that the charge generating layer was deposited on the conductive substrate as a chloroform solution using a conventional spray coating technique (Example 6).

For comparison also photoconductive elements were prepared wherein the charge generating layer consisted solely of perylene pigment VIII (Example 6*a*) and solely of perylene pigment II (Example 6*b*).

The photoelectric properties of the layers where determined in an identical fashion as in examples 1–5. The photosensitivity of the layers is shown in Table 2.

TABLE 2

| Example | Ratio (perylene VIII: perylene II) | $Rm^{550}$ (C/J) | $L^{550}$ (10V) ($mJ/m^2$) |
|---|---|---|---|
| 6 | 10:90 | 0.23 | 6.4 |
| | 20:80 | 0.25 | 5.4 |
| | 30:70 | 0.27 | 5.2 |
| | 50:50 | 0.23 | 6.1 |
| 6a | 100:0 | 0.18 | 6.8 |
| 6b | 0:100 | 0.20 | 7.2 |

$Rm^{550}$: photosensitivity Rm, defined as the amount of positive charge (in $mC/m^2$) needed to discharge the photoconductive element completely, divided by the amount of light ($mJ/m^2$) with a wavelength of 550 nm, needed to discharge the photoconductive element completely, as derived from the slope of the initial discharge in the ASV/L discharge curve, wherein L is the amount of light (in $mJ/m^2$) with a wavelength of 550 nm.

$L^{550}$ (10V): the amount of light in $mJ/m^2$, with a wavelength of 550 nm needed to discharge the photoconductive element to 10V apparent surface voltage.

$Rm^{550}$: photosensitivity Rm, defined as the amount of positive charge (in $mC/m^2$) needed to discharge the photoconductive element completely, divided by the amount of light ($mJ/m^2$) with a wavelength of 550 nm, needed to discharge the photoconductive element completely, as derived from the slope of the initial discharge in the ASV/L discharge curve, wherein L is the amount of light (in $mJ/m^2$) with a wavelength of 550 nm.

$L^{550}$(10V): the amount of light in $mJ/m^2$, with a wavelength of 550 nm needed to discharge the photoconductive element to 10 V apparent surface voltage.

EXAMPLE 7

A multi-layered photoelectric element was prepared according to the method of example 1, using a mixture of a perylene pigment of structure 1, wherein

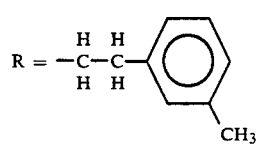

(IX)

and a perylene pigment of structure 1, wherein

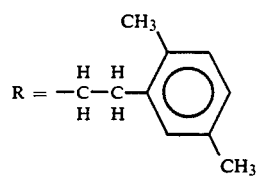

(VI)

The thickness of the charge generating layer was approximate 200 nm. The ratio by weight of pigment IX: pigment VI used, were 25:75, 50:50 and 75:25 by weight (Example 7).

For comparison also photoconductive elements were prepared wherein the charge generating layer consisted solely of perylene pigment IX (Example 7*a*) and solely of perylene pigment VI (Example 7*b*). The photosensitivity of the various layers, determined at 650 nm, is listed in Table 3.

TABLE 3

| Example | Ratio (perylene IX: perylene VI) | $Rm^{650}$ (C/J) | $L^{650}$ (10V) ($mJ/m^2$) |
|---|---|---|---|
| 7 | 25:75 | 0.23 | 7.5 |
| | 50:50 | 0.29 | 5.5 |
| | 75:25 | 0.29 | 5.4 |
| 7a | 100:0 | 0.16 | 8.7 |

TABLE 3-continued

| Example | Ratio (perylene IX: perylene VI) | $Rm^{650}$ (C/J) | $L^{650}$ (10V) ($mJ/m^2$) |
|---|---|---|---|
| 7b | 0:100 | 0.17 | 7.9 |

$Rm^{650}$: photosensitivity Rm, defined as the amount of positive charge (in $mC/m^2$) needed to discharge the photoconductive element completely, divided by the amount of light ($mJ/m^2$) with a wavelength of 650 nm, needed to discharge the photoconductive element completely, as derived from the slope of the initial discharge in the ASV/L discharge curve, wherein L is the amount of light (in $mJ/m^2$) with a wavelength of 650 nm.
$L^{650}$ (10V): the amount of light in $mJ/m^2$, with a wavelength of 650 nm, needed to discharge the photoconductive element to 10V apparent surface voltage.

$L^{650}$ (10V): the amount of light in $mJ/m^2$, with a wavelength of 650 nm, needed to discharge the photoconductive element to 10V apparent surface voltage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-layered electrophotographic element comprising an electrically conductive substrate, and a photoconductive layer on a surface thereof comprising a mixture of charge generating perylene pigments of the following structures:

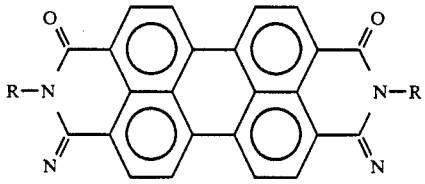

structure 1 wherein R=aryl, alkyl, aralkyl, alkaryl, naphtyl, alkoxyaryl or a heterocyclic group and their substituted derivatives, and

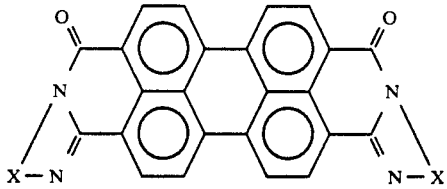

CIS

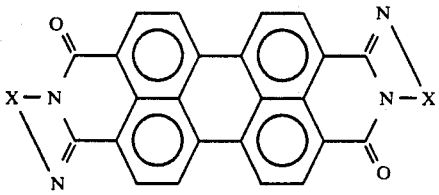

TRANS
structure 2 wherein X=a phenylene, naphtylene, pyridylene or phenanthrene group and the corresponding alkyl, aryl, aralkyl, nitro, chloro, bromo and methoxy substituted derivatives of these groups, wherein said mixture of perylene pigments is selected from the group consisting of a pigment mixture of perylenes of structure 1 with perylenes of structure 2, a pigment mixture of perylenes of structure 1 and a pigment mixture of perylenes of structure 2.

2. A multi-layered electrophotographic element according to claim 1, wherein said mixture of perylene pigments comprises a mixture of a pigment of structure 1, wherein R is an aralkyl group, and a pigment of structure 2.

3. A multi-layered electrophotographic element according to claim 2, wherein said mixture of perylene pigments comprises a mixture of a perylene pigment of structure 1, wherein

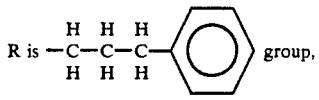

and a perylene pigment of structure 2, wherein X is an o-phenylene group.

4. A multi-layered electrophotographic element according to claim 1, wherein said mixture of perylene pigments comprises a mixture of a first perylene pigment of structure 1, wherein R is a 2-methylbutyl group, and a second perylene pigment of structure 1, wherein

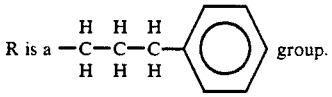

5. A multi-layered electrophotographic element according to claim 4, wherein said perylene mixture is comprised of said first and said second perylene pigments in a ratio of from about 60:40 to 10:90 by weight.

6. A multi-layered electrophotographic element according to claim 1, wherein said mixture of perylene pigments comprises a mixture of a first perylene pigment of structure 1, wherein

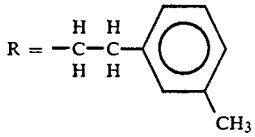

and a second perylene pigment of structure 1, wherein

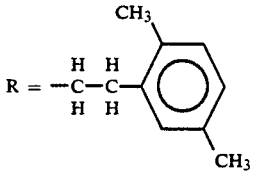

7. A multi-layered electrophotographic element according to claim 6, wherein said perylene mixture is comprised of said first and said second perylene pigments in a ratio of from about 80:20 to 25:75, by weight.

8. A multi-layered electrophotographic element according to claim 6, wherein said perylene mixture is comprised of said first and said second perylene pigments in a ratio of from about 75:25 to 50:50, by weight.

9. A multi-layered electrophotographic element comprising an electrically conductive substrate, and a photoconductive layer on a surface thereof comprising a charge generating layer comprising a mixture of charge generating perylene pigments of the following structures:

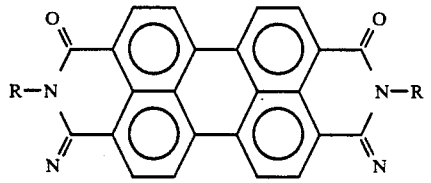

structure 1 wherein R=aryl, alkyl, aralkyl, alkaryl, naphtyl, alkoxyaryl or a heterocyclic group and their substituted derivatives, and

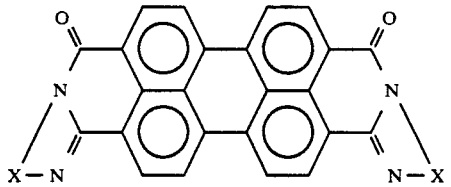

CIS

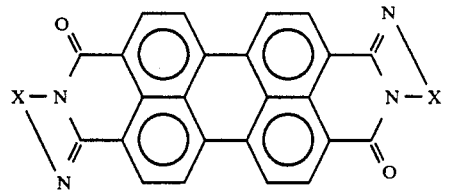

TRANS
structure 2 wherein X=a phenylene, naphtylene, pyridylene or phenantrene group and the corresponding alkyl, aryl, aralkyl, nitro, chloro, bromo and methoxy substituted derivatives of these groups, wherein said mixture of perylene pigments is selected from the group consisting of a pigment mixture of perylenes of structure 1 with perylenes of structure 2, a pigment mixture of perylenes of structure 1 and a pigment mixture of perylenes of structure 2, and a charge transport layer containing as a charge transporting agent, homogeneously distributed in an insulating binder, an azine which has the general structural formula

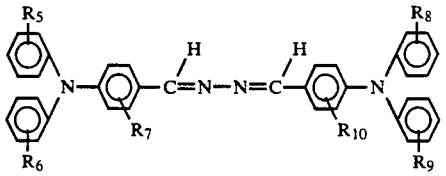

structure 3 wherein $R_5$ and $R_{10}$ each represents a hydrogen atom or an alkyl group having from 1 to 4 carbon atoms and $R_5$ to $R_{10}$ can be the same or different.

10. A multi-layered electrophotographic element according to claim 9, wherein said mixture of perylene pigments comprises a mixture of a pigment of structure 1, wherein R is an aralkyl group, and a pigment of structure 2.

11. A multi-layered electrophotographic element according to claim 10, wherein said mixture of perylene pigments comprises a mixture of a perylene pigment of structure 1, wherein

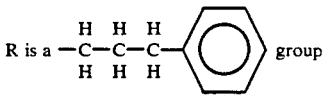

and a perylene pigment of structure 2, wherein X is an o-phenylene group.

12. A multi-layered electrophotographic element according to claim 9, wherein said mixture of perylene pigments comprises a mixture of a first perylene pigment of structure 1, wherein R is a 2-methylbutyl group, and a second perylene pigment of structure 1, wherein

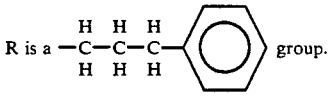

13. A multi-layered electrophotographic element according to claim 12, wherein said perylene mixture is comprised of said first and said second perylene pigments in a ratio of from about 60:40 to 10:90, by weight.

14. A multi-layered electrophotographic element according to claim 9, wherein said mixture of perylene pigments comprises a mixture of a first perylene pigment of structure 1, wherein

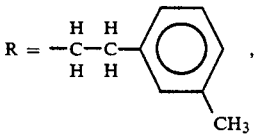

and a second perylene pigment of structure 1, wherein

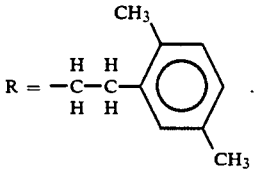

15. A multi-layered electrophotographic element according to claim 14, wherein said perylene mixture is comprised of said first and said second perylene pigments in a ratio of from about 80:20 to 25:75, by weight.

16. A multi-layered electrophotographic element according to claim 15, wherein said perylene mixture is comprised of said first and said second perylene pigments in a ratio of from about 75:25 to 50:50, by weight.

17. An electrophotographic imaging method comprising, providing a multi-layered electrophotographic imaging element comprising an electrically conductive substrate, and a photoconductive layer on a surface of said substrate comprising a mixture of charge generating perylene pigments of the following structures

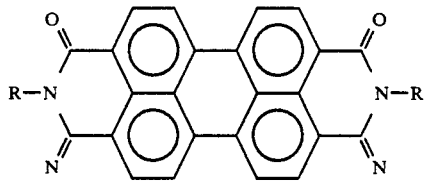

structure 1 and

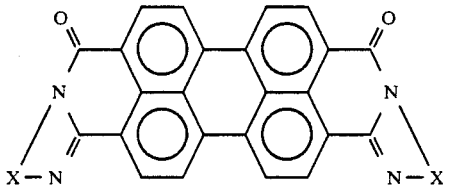

CIS

-continued

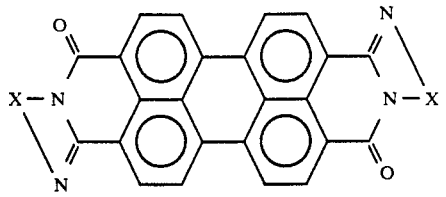

TRANS structure 2 wherein said mixture of perylene pigments is selected from the group consisting of a pigment mixture of perylenes of structure 1 with perylenes of structure 2, a pigment mixture of perylenes of structure 1 and a pigment mixture of perylenes of structure 2, applying a uniform electrostatic charge to said photoconductive layer, selectively exposing said uniformly charged photoconductive layer to light so as to form an electrostatic latent image thereon, and developing said electrostatic latent image with electroscopic toner particles to render said latent image visible.

18. An electrophotographic imaging method as in claim 17, wherein said electrophotographic imaging element further includes a charge transport layer containing as a charge transporting agent, homogeneously distributed in an insulating binder, an azine having the general structural formula

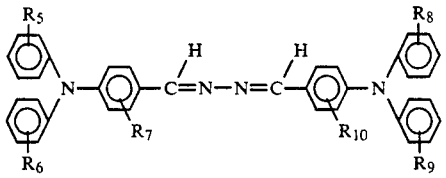

structure 3 wherein $R_5$ and $R_{10}$ each represents a hydrogen atom or an alkyl group having from 1 to 4 carbon atoms.

* * * * *

UNITED STATES PATENT AND TRADEMARK OFFICE

CERTIFICATE OF CORRECTION

PATENT NO. : 5,330,865

DATED : July 19, 1994

INVENTOR(S) : Leus, et al

It is certified that error appears in the above-indentified patent and that said Letters Patent is hereby corrected as shown below:

On the title page, in the Abstract, at column 3, lines 1-10; at column 11, lines 28-38 in claim 1; at column 13, lines 7-16 in claim 9; and at column 15, lines 10-20 in claim 17, Structure 1, should read as shown on the attached page.

UNITED STATES PATENT AND TRADEMARK OFFICE

CERTIFICATE OF CORRECTION

PATENT NO. : 5,330,865

DATED : July 19, 1994

INVENTOR(S) : Leus, et al

It is certified that error appears in the above-indentified patent and that said Letters Patent is hereby corrected as shown below:

change

"

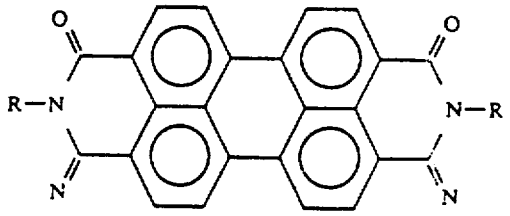

structure 1

"

to:

--

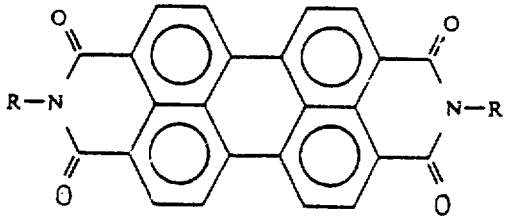

structure 1

.--

UNITED STATES PATENT AND TRADEMARK OFFICE

CERTIFICATE OF CORRECTION

PATENT NO. : 5,330,865
DATED : July 19, 1994
INVENTOR(S) : Leus et al.

It is certified that error appears in the above-indentified patent and that said Letters Patent is hereby corrected as shown below:

At column 5, lines 1-9, change the chemical formula from:

" 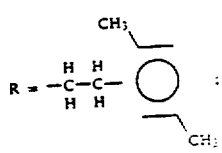 (VI) ; "

to

-- 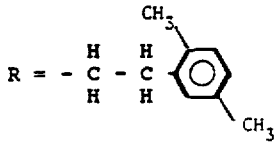 (VI) ; --.

Signed and Sealed this

Second Day of July, 1996

*Attest:*

*Attesting Officer*

BRUCE LEHMAN

*Commissioner of Patents and Trademarks*